US006916156B2

(12) United States Patent
Tseng

(10) Patent No.: US 6,916,156 B2
(45) Date of Patent: Jul. 12, 2005

(54) CONNECTING ASSEMBLY OF A CEILING FAN FOR FIXING BLADES

(76) Inventor: Ming-Chi Tseng, No. 18, Jhensing E. St., Wufong Township, Taichung County (TW)

( * ) Notice: Subject to any disclaimer, the term of this patent is extended or adjusted under 35 U.S.C. 154(b) by 37 days.

(21) Appl. No.: 10/601,565

(22) Filed: Jun. 24, 2003

(65) Prior Publication Data

US 2004/0265131 A1 Dec. 30, 2004

(51) Int. Cl.[7] ..... B63H 15/00

(52) U.S. Cl. ..... 416/206; 416/210 R; 416/220 A; 416/221; 417/423.1; 417/424.1; 417/360; 403/321; 403/322.1; 403/322.4; 403/324; 403/325

(58) Field of Search ..... 416/206, 207, 416/210 R, 220 A, 221; 403/321, 322.1, 322.4, 324, 325; 417/423.1, 424.1, 360

(56) References Cited

U.S. PATENT DOCUMENTS 6,059,531 A * 5/2000 Tai ..... 416/220 A
6,378,824 B1 * 4/2002 Tseng ..... 416/210 R
6,692,233 B2 * 2/2004 Liang ..... 416/221

* cited by examiner

*Primary Examiner*—Theresa Trieu
(74) *Attorney, Agent, or Firm*—Rosenberg, Klein & Lee

(57) ABSTRACT

A connecting assembly of a ceiling fan for fixing blades includes a connecting device mounted to a motor of the ceiling fan and a seat having multiple grooves radially defined in a bottom of the seat. The grooves extend to an outer periphery of the seat. A channel is laterally defined in one side of each of the multiple grooves and laterally communicates with the groove. A buckle is movably received in a corresponding one of the channels. A bracket has a first end inserted into a corresponding one of the multiple grooves and a second end adapted to connected to a blade of the ceiling fan. Each bracket has an indentation laterally defined for selectively partially receiving the buckle to hold the bracket in place when the first end of the bracket is inserted into the corresponding one of the multiple grooves in the seat.

11 Claims, 9 Drawing Sheets

CONNECTING ASSEMBLY OF A CEILING FAN FOR FIXING BLADES

BACKGROUND OF THE INVENTION

1. Field of the Invention

The present invention relates to a connecting assembly, and more particularly to a connecting assembly of a ceiling fan for fixing blades.

2. Description of Related Art

A ceiling fan usually has at least three blades. For reducing a volume of the ceiling when being stored or freighting, the blades is designed to be detachable from the ceiling fan such that a connected assembly for detachably fixing the blades is needed.

A conventional connecting assembly of a ceiling fan for fixing the blades in accordance with the prior art shown in FIGS. 9, 10 and 11 comprises a seat (7) adapted to be connected to a motor (not shown) that is received in a casing (6). The seat (7) includes at least three channels (71) radially defined in the outer periphery of the seat (7) and equally divided the outer periphery into at least three sections. A recess (70) is defined in a bottom of the seat (7) and at least three through holes (710) is defined in a bottom of the recess (70). Each through hole (710) communicates with a corresponding one of the at least three channels (71) in the seat (7). Each channel (71) has a bracket (8) partially radially inserted into the seat (7) and detachably received in the seat (7). The bracket (8) is adapted to connect to a blade (81). At least three snappers (72) each is movably received in a corresponding one of the at least three through holes (710) and extends into a corresponding one of the at least three channels (71) in the seat (7) to selectively hold the bracket (8) in place. The moving direction of the snapper (72) is parallel to an axis of the seat (7). A rod (74) downward extends from the snapper (72) and through a spring (73). A plate (75) is received in the recess (70) and held in place by multiple bolts (750) that are screwed into the bottom of the recess (70). The plate (75) is mounted apart from the bottom of the recess (70) such that the spring (73) is compressively received between the snapper (72) and the plate (75). A button (76) is secured on a free end of the rod (74) after the rod extending through the plate (75). Consequently, the snapper (72) is detached from the bracket (8) when the user downward pulls the button (75) and then the bracket (8) can be detached from the seat (7). The spring (73) provides a restitution force to the snapper (72) when the snapper is downward pulled.

Furthermore, the ceiling fan usually comprises a switch device (62) mounted under the seat (7) and a lamp (61) mounted under the switch device (62). For easily pull the button (76) and the snapper (72), the distance between the switch device (62) and the button (76) must be elongated. Consequently, the lamp (61) becomes close to and forms a not-harmony sense to the user.

The snapper (72) is engaged to the recess (82) in the bracket (8) due to the restitution force of the spring (73). For a good connection between the snapper and the bracket (8), the coefficient of elasticity of the spring (73) must be great. However, a spring with a great coefficient of elasticity is hard to be compressed, that is, the conventional connecting assembly of a ceiling fan for fixing blades in accordance with the prior art is hard to be operated.

The present invention has arisen to mitigate and/or obviate the disadvantages of the conventional connecting assembly of a ceiling fan for fixing blades.

SUMMARY OF THE INVENTION

The main objective of the present invention is to provide an improved connecting assembly of a ceiling fan for fixing blades. The connecting assembly of the present invention is easily assembled and has a good connection.

To achieve the objective, the connecting assembly in accordance with the present invention comprises a connecting device mounted to a motor of the ceiling fan and a seat having multiple grooves radially defined in a bottom of the seat. The grooves extend to an outer periphery of the seat. A channel is laterally defined in one side of each of the multiple grooves and laterally communicates with the groove. A buckle is movably received in a corresponding one of the channels. A bracket has a first end inserted into a corresponding one of the multiple grooves and a second end adapted to connected to a blade of the ceiling fan. Each bracket has an indentation laterally defined for selectively partially receiving the buckle to hold the bracket in place when the first end of the bracket is inserted into the corresponding one of the multiple grooves in the seat.

Further benefits and advantages of the present invention will become apparent after a careful reading of the detailed description with appropriate reference to the accompanying drawings.

DETAILED DESCRIPTION OF THE INVENTION

Figure 1:
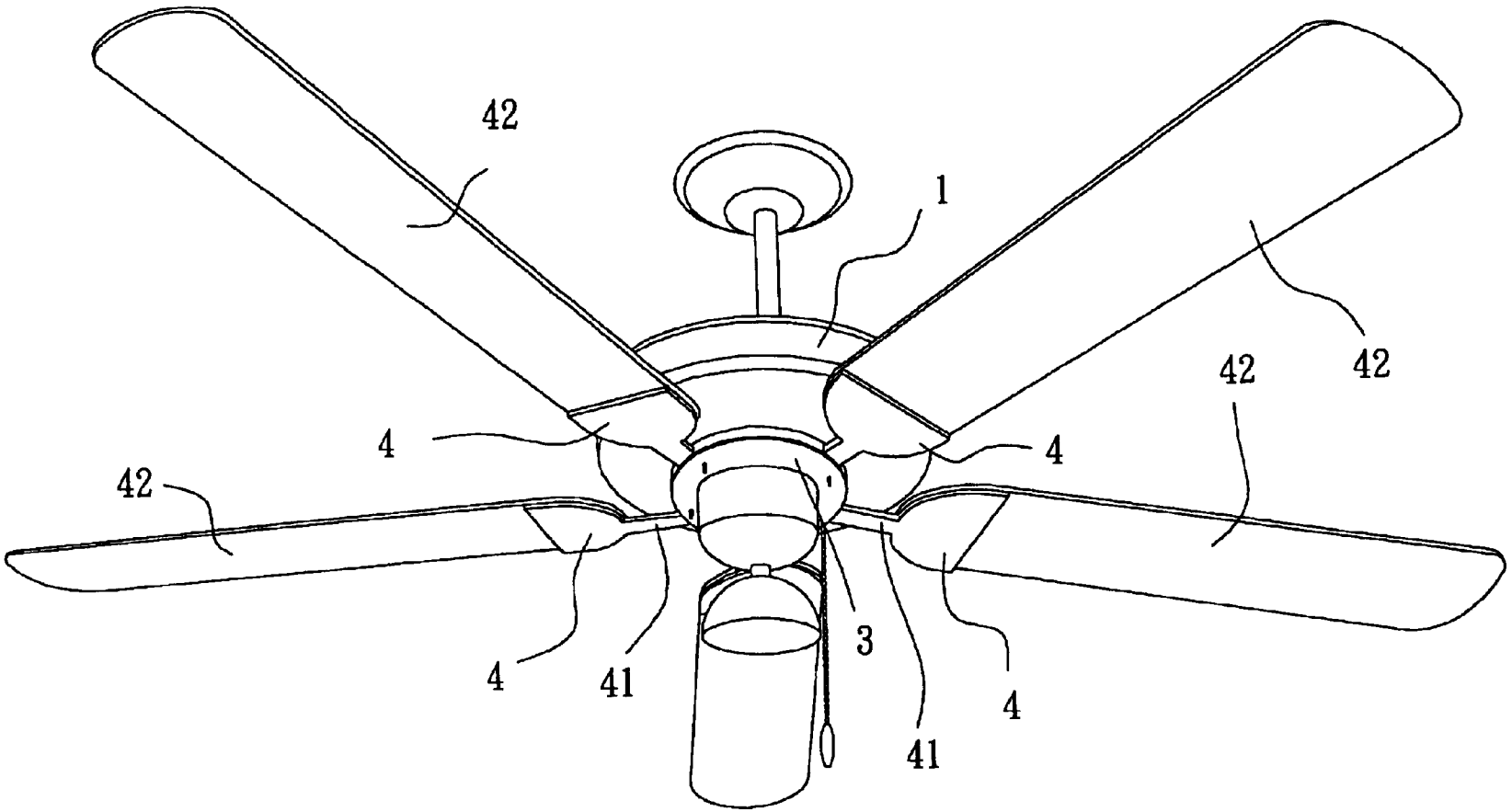
FIG. 1 is a perspective schematic view of a connecting assembly of a ceiling fan for fixing blades in accordance with the present invention.
Figure 2:
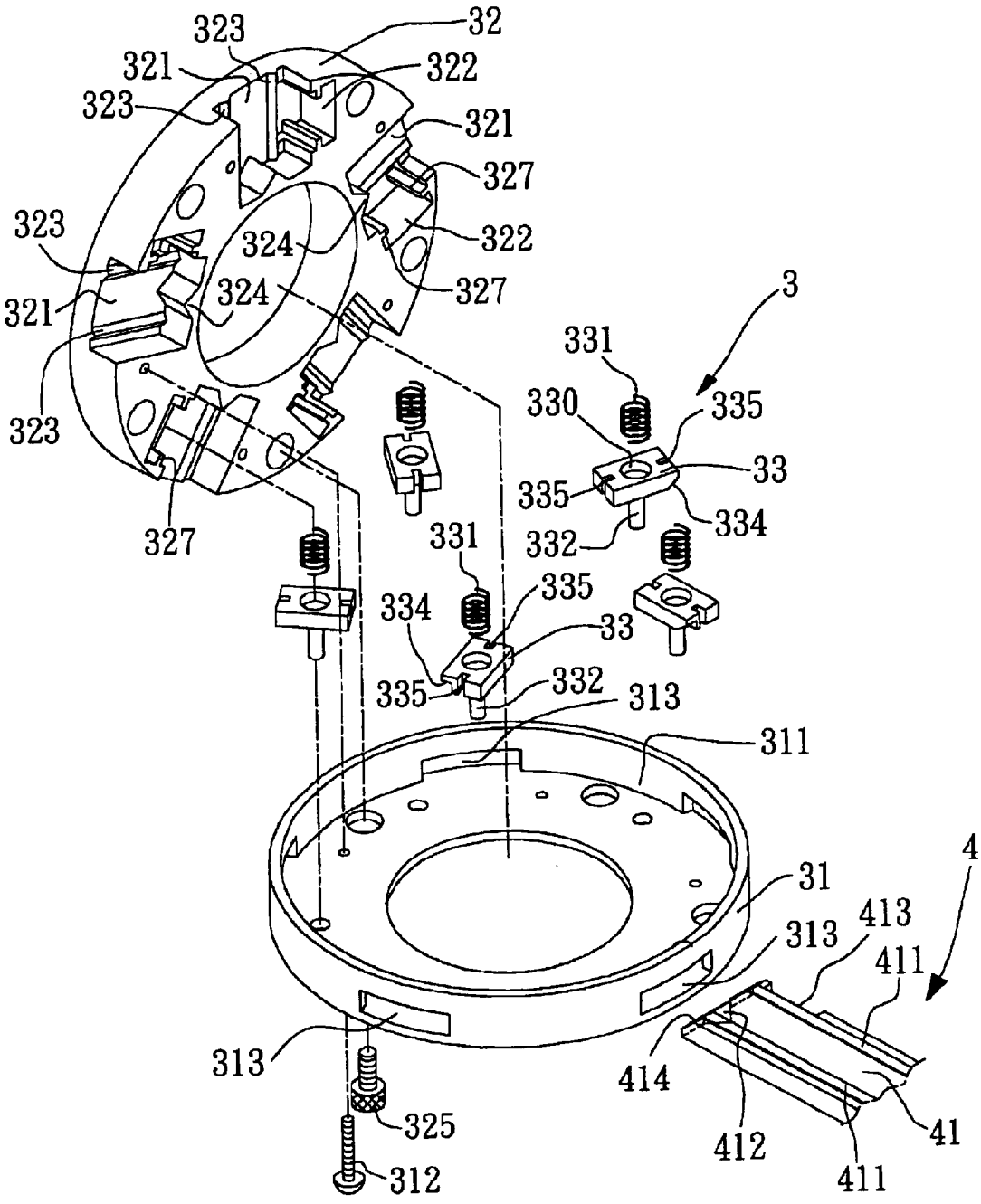
FIG. 2 is an exploded perspective view of the connecting assembly in FIG. 1.
Figure 3:
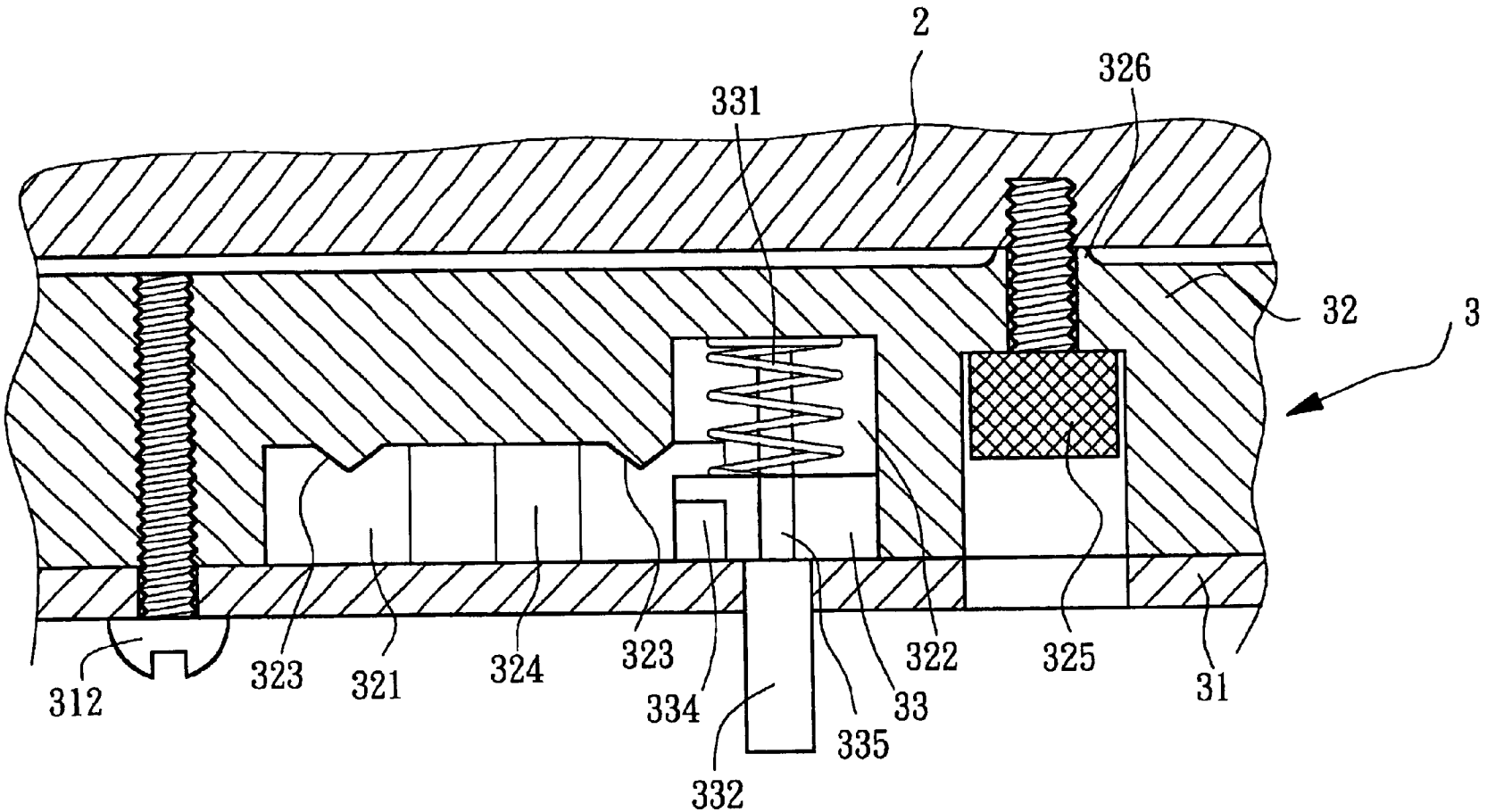
FIG. 3 is a partially cross-sectional view of the connecting assembly in FIG. 1

Referring to the drawings and initially to FIGS. 1–3, a connecting assembly of a ceiling fan for fixing blades in accordance with the present invention comprises a connecting device (3) mounted under a motor (2) that is received in a casing of the ceiling fan, and multiple brackets (4) each partially detachably received in the connecting device (3). Each bracket (4) is adapted to be connected to a blade of the ceiling fan.

The connecting device (3) includes a cover (31) having a skirt (311) extending from a periphery thereof and multiple entrances (313) is laterally defined in and extending through the skirt (311). A seat (32) is received in the cover (31) within the skirt (311) and multiple buckles (33) movably received in the seat (32). The seat (32) is held in place by multiple first bolts (312) that extend through the bottom of the cover (31) and are screwed into the seat (32). The seat (32) with the cover (31) is securely mounted to a rotor (not shown) of the motor (2) by multiple second bolts (325) that are partially received in the seat (32), extend through the seat (32) and are screwed into the rotor of the motor (2). The seat (32) has multiple protrusions (326) extending therefrom. Each protrusion (326) extends toward the motor (2) and co-axially corresponds to a corresponding one of the multiple second bolts (325). Consequently, a gap (not numbered) is formed between the seat (32) and the motor (2) for dissipating the heat caused by the motor (2). The seat (32) includes multiple grooves (321) radially defined in a bottom of the seat (32) and extending to an outer periphery of the seat (32). Each groove (321) aligns with and communicates with a corresponding one of the entrances (313) in the cover (31) for allowing the bracket (4) extending through the entrance (313) and inserted into the seat (32). A channel (322) is laterally defined in a one side of each of the multiple grooves (321). The channel (322) laterally communicates with a corresponding one of the grooves (321). Each channel (322) includes two opposite sides each having a rib (327) longitudinally extending relative to the seat (32). Two parallel rails (323) extend from a bottom of each of the grooves (321) and parallel to an axis of each of the grooves (321). A stopper (324) extends from one side of each of the grooves (321) between the two rails (323) and toward the outer periphery of the seat (32).

A buckle (33) is movable received in a corresponding one of the channel (322) and laterally extends into a corresponding one of the grooves (321). The buckle (33) includes a first side having a recess (330) defined in the buckle (33) and a second side having a rod (332) perpendicularly extending from the buckle (33). The rod (332) downward extends through the cover (31) for user to upwardly push the buckle (33). A spring (331) is partially compressively received in the recess (330) and abuts a bottom of the channel (322) for providing a restitution force to the buckle (33) after the buckle (33) being moved toward the bottom of the channel (322). The buckle (33) includes two opposite ends each having a slit (335) defined to slidably receive the two ribs (327) in a corresponding one of the channels (322) for guiding the buckle (33) moved in the channel (322). The buckle (33) includes a first side laterally extending into a corresponding one of the grooves (321) and having a downward guiding portion (334) formed and facing the outer periphery of the seat (32).

The bracket (4) includes an elongated arm (41) inserted into and selectively secured in a corresponding one of the grooves (321). The elongated arm (41) includes two notches (411) longitudinally defined in a top surface thereof for slidably receiving the rails (323) in a corresponding one of the grooves (321) and radially guiding the elongated arm (41) inserted into the seat (32). A cutout (412) is defined in a front end of the elongated arm (41) for receiving the stopper (324) in a corresponding one of the grooves (321) when the elongated arm (41) is secured in the corresponding one of the grooves (321). The elongated arm (41) includes one side facing the channel (322) and having an indentation (413) defined to selectively receive the first side of a corresponding one of the buckle (33) to hold the elongated arm (41) in place in the seat (32). An upward guiding portion (414) is formed on the front end of the elongated arm (41) and complementally corresponding to the downward guiding portion (334) of the buckle (33). The upward guiding portion (414) upwardly pushes the buckle (33) due to the downward guiding portion (334) of the buckle (33) when the elongated arm (41) is inserted into the seat (32).

Figure 4:
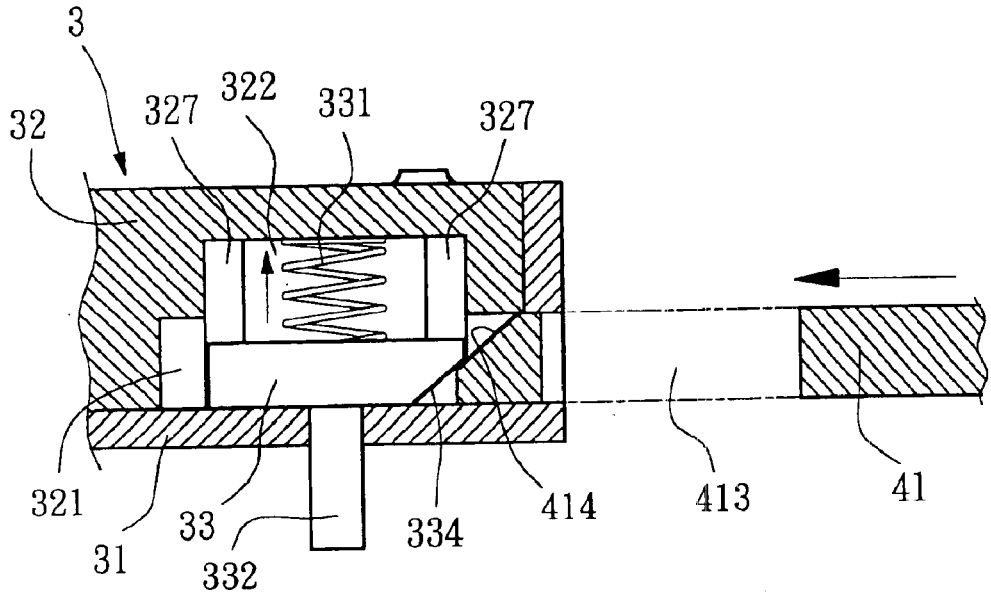
FIG. 4 is an operational view in cross-section of the connecting assembly in FIG. 1 when assembling the blade.
Figure 5:
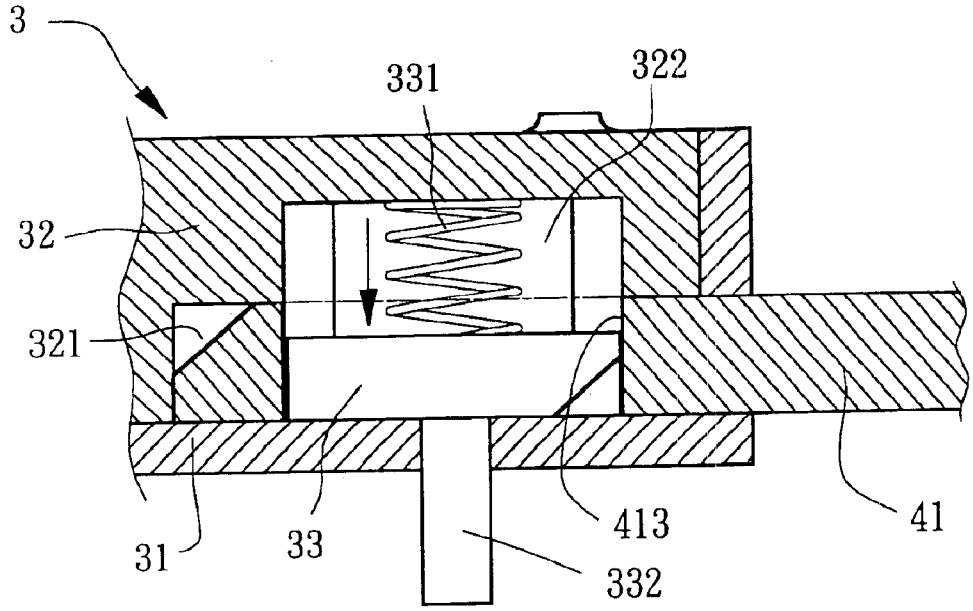
FIG. 5 is a partially cross-sectional view when the blade is securely mounted.
Figure 6:
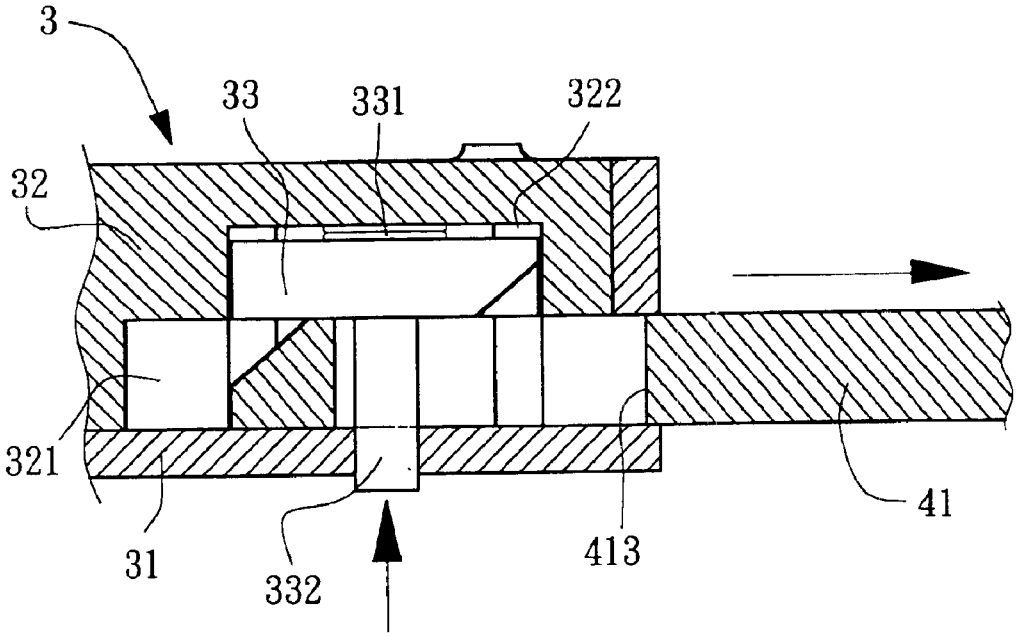
FIG. 6 is an operational view in cross-section of the connecting assembly in FIG. 1 when disassembling the blade.

With reference to FIGS. 4 to 6, when assembling the connecting assembly in accordance with the present invention, each elongated arm (41) is inserted into the corresponding one of the grooves (321) in the seat (32) and the elongated arm (41) upwardly pushes the buckle (33) due to the downward guiding portion (334) of the buckle (33) and the upward guiding portion (414) of the elongated arm (41). The buckle (33) is downwardly moved to engage to the indentation (413) for holding the bracket (4) in place due to the restitution force of the spring (331) when the buckle (33) aligns with the indentation (413). When detaching the bracket (4) from the seat (32), the rod (332) is upwardly pushed to make the buckle (33) escaping from the indentation (413) and then the user can conveniently detach the bracket (4) from the seat (32).

Figure 7:
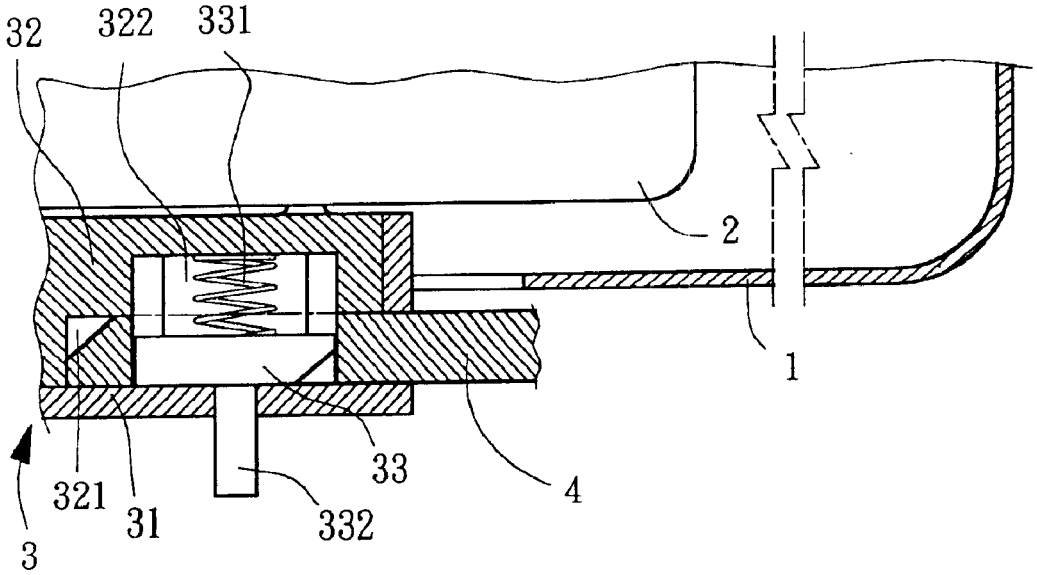
FIG. 7 is a partially cross-sectional view when the blade is detached from the ceiling fan.

With reference to FIG. 7, the groove (321) and the channel (322) are adjacent to each other so that the height of the seat (32) is reduced and the seat (32) can be partially received in a casing (1) of the ceiling fan under the motor (2) to prevent the connecting assembly excessively raised relative to the casing (1) of the ceiling fan. The elongated arm (41) and the buckle (33) are adjacent to each other when the elongated arm (41) is inserted into and secured in the seat (32) because the groove (321) and the channel (322) are defined and adjacent to each other. Consequently, the elongated arm (41) does not provide a height to allow the buckle (33) reciprocally moved therein such that a height of the elongated arm (41) is reduced. As described above, the heights of the seat (32) and the elongated arm (41) are reduced such the difference between the connecting device (3) and the casing (1) of the ceiling fan is reduced to provide a harmony and complete vision effect.

Figure 8:
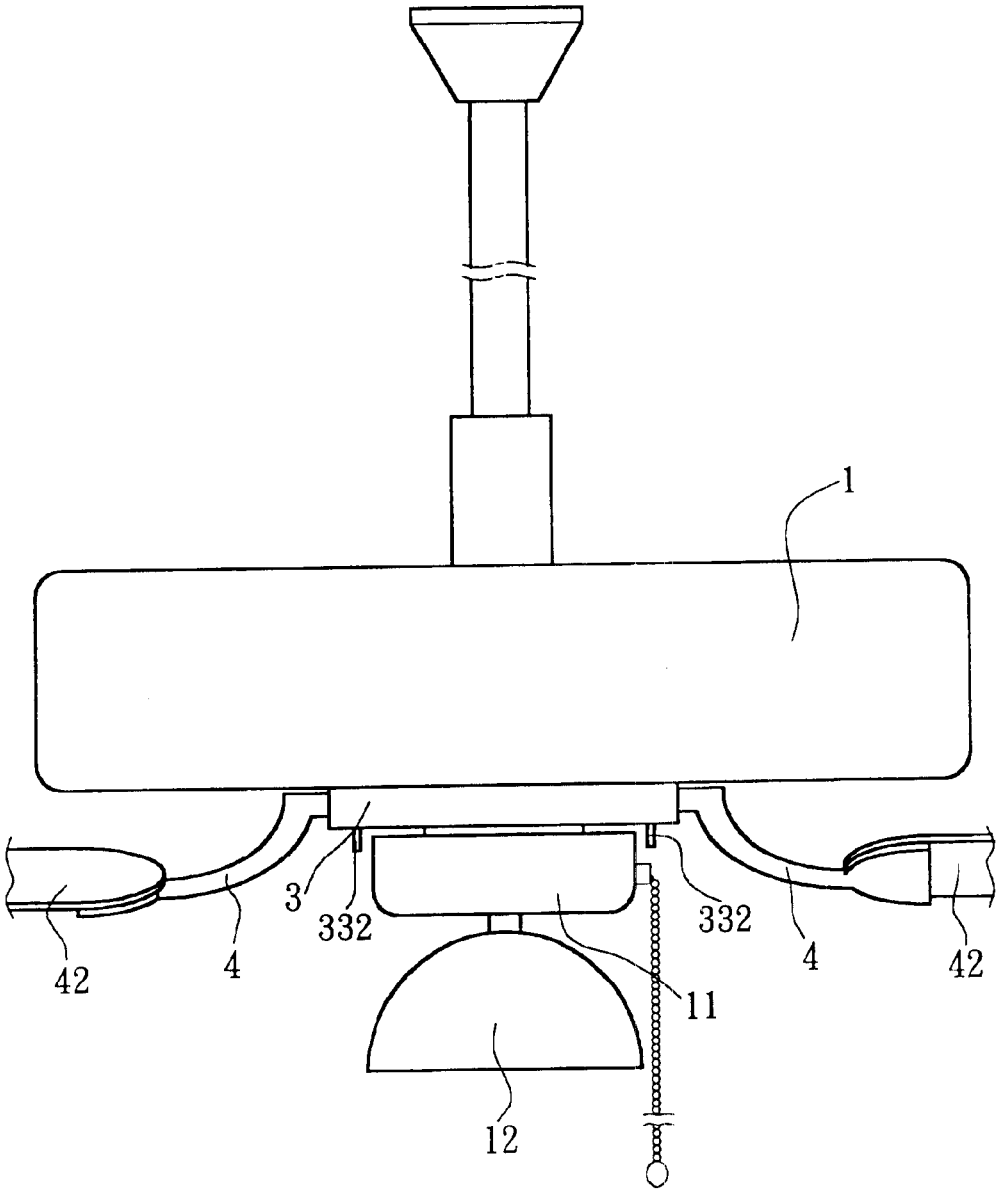
FIG. 8 is a side plan schematic view of a connecting assembly of a ceiling fan for fixing blades in accordance with the present invention.
Figure 9:
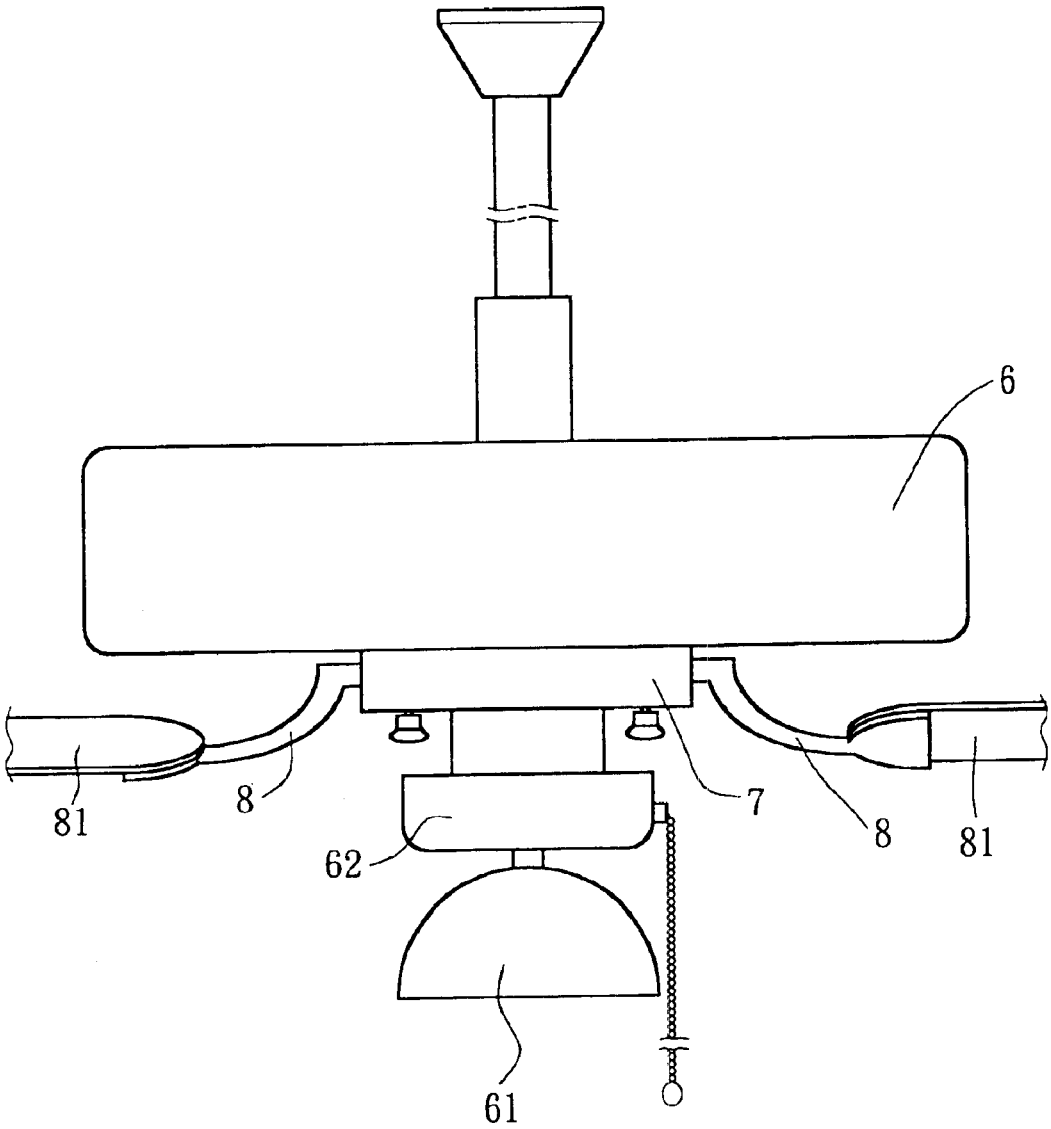
FIG. 9 PRIOR ART
FIG. 9 is a side schematic plan view of a conventional connecting assembly of a ceiling fan for fixing blades in accordance with the prior art.
Figure 10:
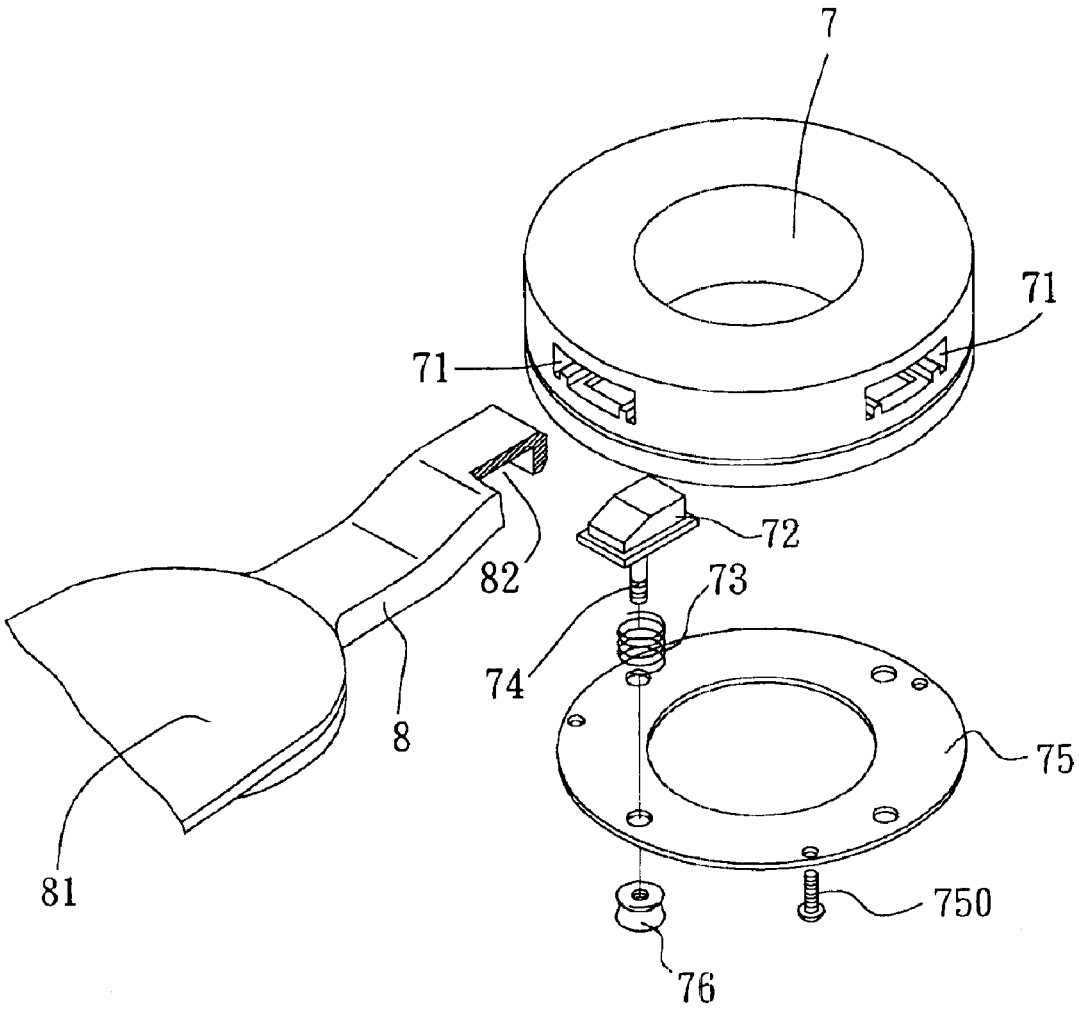
FIG. 10 PRIOR ART
FIG. 10 is an exploded perspective view of the conventional connecting assembly in FIG. 9.
Figure 11:
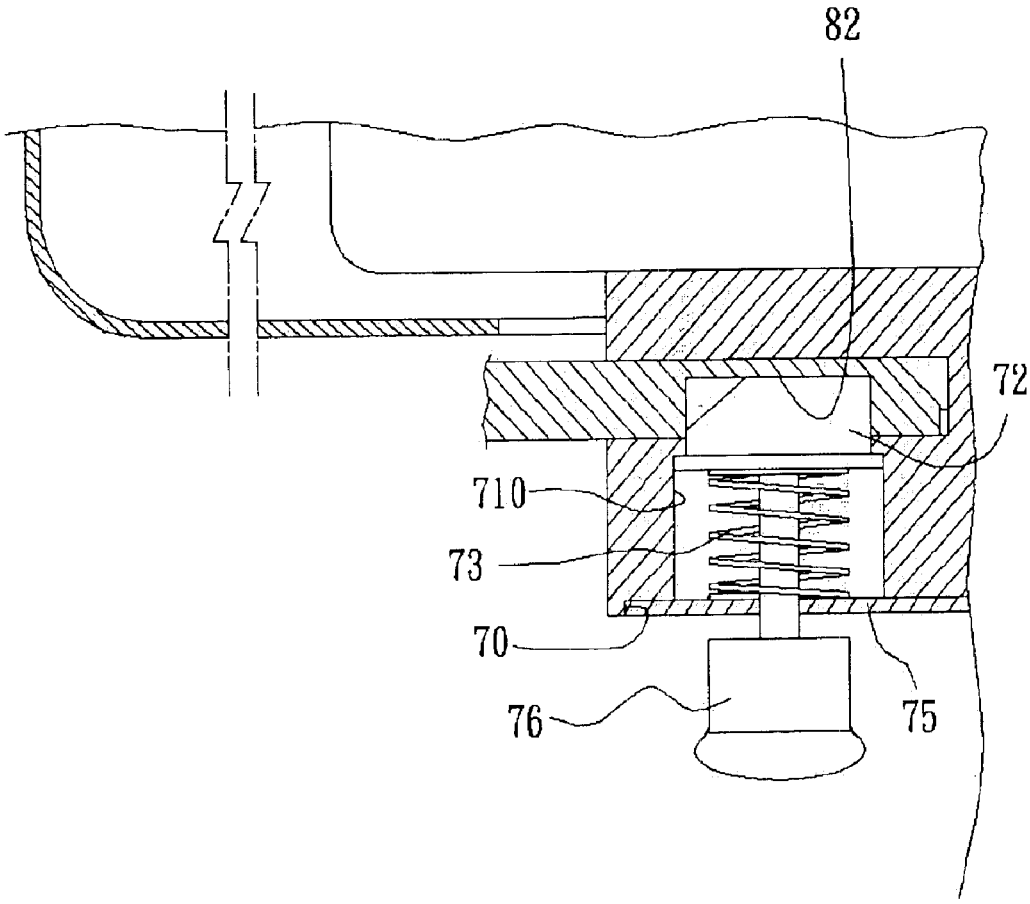
FIG. 11 PRIOR ART
FIG. 11 is a partially cross-sectional view of the conventional connecting assembly in FIG. 9.

With reference to FIGS. 7 and 8, the rod (332) and the buckle (33) is upwardly moved when assembling/detaching the bracket (4) such that the user can conveniently operate the connecting assembly of the present invention even when a switch device (11) is mounted under the connecting device (3). Furthermore, the rails (323), the stopper (324) in the groove (321), and the notches (411) and the cutout (412) in the bracket (4) can guide the elongated arm (41) into and positioned in the seat (3) and provide a good connection between the seat (3) and the bracket (4).

Although the invention has been explained in relation to its preferred embodiment, it is to be understood that many other possible modifications and variations can be made without departing from the spirit and scope of the invention as hereinafter claimed.

What is claimed is:

1. A connecting assembly of a ceiling fan for fixing blades, comprising:

a connecting device adapted to be mounted to a motor of the ceiling fan, the connecting device including a seat adapted to be attached to a bottom of the motor, the seat including multiple grooves radially defined in a bottom of the seat and extending to an outer periphery of the seat, a channel laterally defined in one side of each of the multiple grooves and laterally communicating with the corresponding one of the multiple grooves, a buckle movably received in a corresponding one of the channels; and multiple brackets each having a first end inserted into a corresponding one of the multiple grooves and a second end adapted to be connected to a blade of the ceiling fan, each bracket having an indentation laterally defined in the bracket for selectively partially receiving a corresponding one of the buckles to hold the bracket in place when the first end of the bracket is inserted into the corresponding one of the multiple grooves in the seat, each bracket includes an elongated arm formed on the first end thereof and the indentation being defined in the elongated arm;

the connecting device further including:

a cover having a skirt extending from a periphery of the cover and the seat received in the cover within the skirt, the seat held in place by multiple first bolts that extend through the cover and are screwed into the seat;

multiple entrances laterally defined in and extending through the skirt, each entrance aligning with a corresponding one of the multiple grooves for allowing the elongated arm of the bracket inserted into the seat;

a recess defined in a first side of each of the buckle;

a spring partially compressively received in the recess and abutting a bottom of the channel for providing a restitution force to the buckle after the buckle being upwardly moved toward the bottom of the channel; and a rod perpendicularly extending from a second side of each of the buckle and through the cover for user to upwardly push the buckle to make the buckle detaching from the indentation of the bracket.

2. The connecting assembly as claimed in claim 1, wherein:

the seat comprises two parallel rails extending from a bottom of each of the multiple grooves and parallel to an axis of a corresponding one of the multiple grooves, and a stopper extending from one side of the each of the multiple grooves between the two parallel rails and toward the outer periphery of the seat; and the elongated arm comprises two notches longitudinally defined in a top surface thereof for slidably receiving the two parallel rails in a corresponding one of the multiple grooves for radially guiding the elongated arm inserted into the seat, and a cutout defined in a front end of the elongated arm for receiving the stopper in the corresponding one the multiple grooves when the elongated arm is secured in the corresponding on the multiple grooves.

3. The connecting assembly as claimed in claim 2, wherein:

the buckle comprises a first side laterally extending into the corresponding one of the multiple grooves and having a downward guiding portion formed and facing the outer periphery of the seat; and the elongated arm comprises an upward guiding portion formed on a front end of the elongated arm and complementally corresponding to the downward guiding portion of the buckle, whereby the upward guiding portion upwardly pushes the buckle due to the downward guiding portion of the buckle when the elongated arm is inserted into the seat.

4. The connecting assembly as claimed in claim 2, wherein the channel comprises two opposite sides each having a rib longitudinally extending relative to the seat and the buckle comprises two opposite ends each having a slit defined to slidably receive the two ribs in a corresponding one of the channels for guiding the buckle moved in the channel.

5. The connecting assembly as claimed in claim 2, wherein the seat comprises multiple protrusions extending from a top surface thereof toward the motor of the ceiling fan, whereby a gap is formed between the seat and the motor for dissipating the heat cause by the motor.

6. The connecting assembly as claimed in claim 1, wherein:

the buckle comprises a first side laterally extending into the corresponding one of the multiple grooves and having a downward guiding portion formed and facing the outer periphery of the seat; and the elongated arm comprises an upward guiding portion formed on a front end of the elongated arm and complementally corresponding to the downward guiding portion of the buckle, whereby the upward guiding portion upwardly pushes the buckle due to the downward guiding portion of the buckle when the elongated arm is inserted into the seat.

7. The connecting assembly as claimed in claim 6, wherein the channel comprises two opposite sides each having a rib longitudinally extending relative to the seat and the buckle comprises two opposite ends each having a slit defined to slidably receive the two ribs in a corresponding one of the channels for guiding the buckle moved in the channel.

8. The connecting assembly as claimed in claim 6, wherein the seat comprises multiple protrusions extending from a top surface thereof toward the motor of the ceiling fan, whereby a gap is formed between the seat and the motor for dissipating the heat cause by the motor.

9. The connecting assembly as claimed in claim 1, wherein the channel comprises two opposite sides each having a rib longitudinally extending relative to the seat and the buckle comprises two opposite ends each having a slit defined to slidably receive the two ribs in a corresponding one of the channels for guiding the buckle moved in the channel.

10. The connecting assembly as claimed in claim 9, wherein the seat comprises multiple protrusions extending from a top surface thereof toward the motor of the ceiling fan, whereby a gap is formed between the seat and the motor for dissipating the heat cause by the motor.

11. The connecting assembly as claimed in claim 1, wherein the seat comprises multiple protrusions extending from a top surface thereof toward the motor of the ceiling fan, whereby a gap is formed between the seat and the motor for dissipating the heat cause by the motor.

* * * * *